United States Patent [19]

Jacobs

[11] 4,368,378

[45] Jan. 11, 1983

[54] ELECTRIC HEATING ELEMENTS

[75] Inventor: David F. Jacobs, Pittsburgh, Pa.

[73] Assignee: Emerson Electric Co., St. Louis, Mo.

[21] Appl. No.: 957,891

[22] Filed: Nov. 6, 1978

[51] Int. Cl.[3] ..... H05B 3/08

[52] U.S. Cl. ..... 219/451; 219/447

[58] Field of Search ..... 219/445, 446, 447, 449, 219/450, 451, 455, 458, 460, 461, 463–467, 472, 476, 477–480; 339/65, 66 R, 66 M, 66 T, 186

[56] References Cited

U.S. PATENT DOCUMENTS

| | | | |
|---|---|---|---|
| 1,130,935 | 3/1915 | Shailor | 339/65 |
| 3,016,445 | 1/1962 | Lien, Jr. | 219/451 |
| 3,174,028 | 3/1965 | Ammerman | 219/455 |
| 3,246,123 | 4/1966 | Ammerman et al. | 219/451 |
| 3,327,095 | 6/1967 | Hanson | 219/451 |
| 3,328,562 | 6/1967 | Jasionowski | 219/451 |
| 3,346,719 | 10/1967 | Jasionowski | 219/451 |
| 3,447,121 | 5/1969 | Ammerman et al. | 219/451 |
| 3,466,427 | 9/1969 | Burger | 219/451 |
| 3,506,805 | 4/1970 | Sauder | 219/451 |
| 3,569,671 | 3/1971 | Henning | 219/451 |
| 3,571,562 | 3/1971 | Cunningham | 219/451 |
| 3,750,092 | 7/1973 | Bury | 219/451 |
| 3,767,897 | 10/1973 | Prucha et al. | 219/451 |
| 4,029,896 | 6/1977 | Skinner | 219/451 |

FOREIGN PATENT DOCUMENTS

| | | | |
|---|---|---|---|
| 289583 | 1/1968 | Australia | 219/451 |

*Primary Examiner*—Bernard Roskoski

*Attorney, Agent, or Firm*—Michael Williams

[57] ABSTRACT

An electric heating element for disposition on the top surface of a cooking range, having electrical terminals for plug-in connection with contacts disposed within a dielectric terminal block. The block is supported on the rangetop by means of a sheet-metal mounting bracket. The bracket has a pair of laterally-spaced connecting fingers, each removably contained within a respective socket in the terminal block and adapted to permit limited vertical and lateral movement of the terminal block. The bracket and terminal block are easily assembled without need of any tools.

6 Claims, 7 Drawing Figures

ELECTRIC HEATING ELEMENTS

BACKGROUND AND SUMMARY

The concept of a sheet-metal bracket attached to a rangetop and adapted to support a dielectric terminal block is known in the art, and a good example is found in U.S. Pat. No. 3,571,562, issued Mar. 23, 1971, to Donald M. Cunningham and assigned to the same assignee as the present application.

My invention provides a metal support bracket and terminal block wherein the two may be easily assembled without the use of tools and wherein the support bracket is a unitary structure which may be produced by conventional metal stamping and forming operations.

DESCRIPTION OF THE DRAWINGS

In the drawings accompanying this specification and forming a part of this application there is shown, for purpose of illustration, an embodiment which my invention may assume, and in these drawings.

DESCRIPTION OF THE PREFERRED EMBODIMENT

Figure 4:
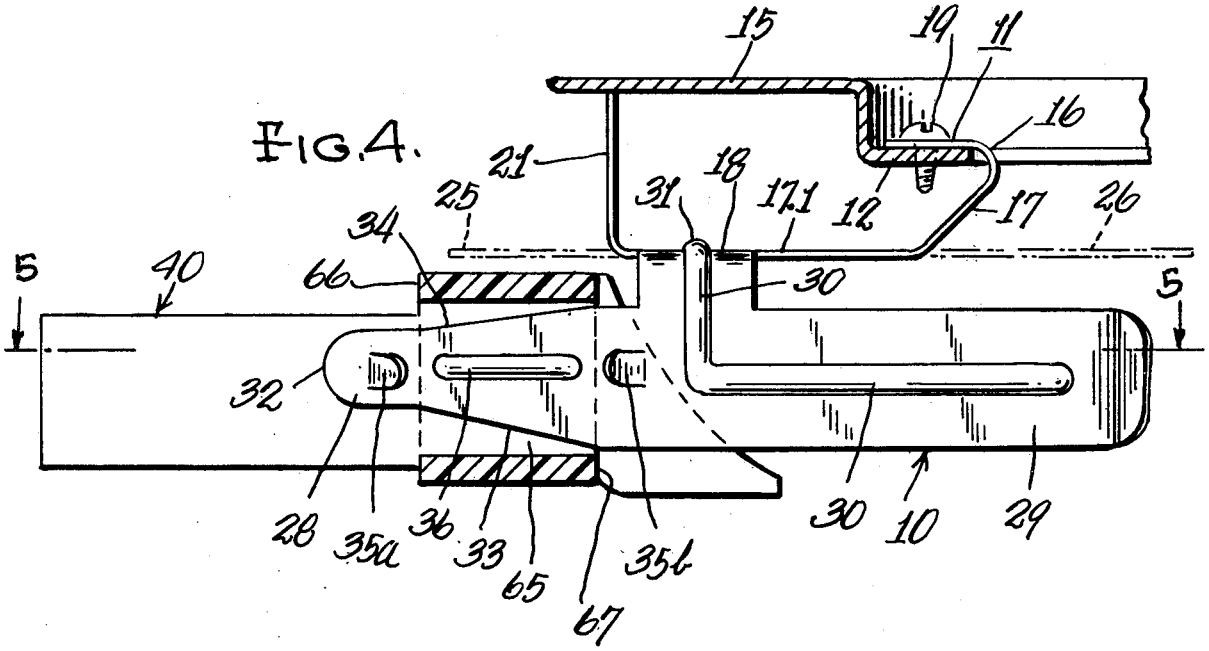
FIG. 4 is a sectional view corresponding generally to the line 4—4 of FIG. 5.

As seen in FIG. 4 the mounting bracket 10 has a lip 11 adapted to be connected to an annular ledge 12 defining an opening in a stovetop 15. A surface unit (not shown) is adapted to be positioned within the opening in customary manner, such as shown in U.S. Pat. No. 3,447,121, issued May 27, 1969, to G. E. Ammerman and D. M. Cunningham, and assigned to the same assignee as the present application.

The lip 11 has a rounded nose portion 16 which merges with an upwardly inclined portion 17, the latter merging with a narrowed extension 17.1 of the top wall 18 of the bracket. The bracket is formed from sheet metal, such as stainless steel and the like, so that the lip 11, nose portion 16 and inclined position 17 provide a desired amount of springiness in the mounting of the bracket. A sheet-metal screw 19 (see FIG. 4) passes through an aperture 20 in the lip 11 and is threaded into an aperture in the ledge 12.

The bracket top wall 18 has an upwardly extending finger 21, the terminal end of which engages the undersurface of the stovetop for steadying purposes, as seen in FIG. 4. Stovetop panels vary in design and the lip 11 may be secured to the panel opening ledge 12 in the manner shown in FIG. 4 (and FIG. 7 of said Cunningham U.S. Pat. No. 3,571,562) or, if the panel opening has no ledge, the lip may be secured to the panel in the manner shown in FIG. 1 of said Cunningham patent. Also, the distance between the topwall 18 of the bracket 10 and the undersurface of the top panel 15 varies in different constructions. Therefore the bracket topwall 18 is initially formed with straight continuations 25, 26 shown in dot-dash lines in FIG. 4, and these continuations are formed to configurations to fit the requirements of the particular stovetop.

Opposed sidewalls 27–27 are integral with and extend downwardly from the bracket topwall 18. Each sidewall has an integral rearwardly-extending finger 28 and an integral forwardly-extending blade-like arm 29. The arms 29 and sidewalls 27 are formed with stiffening beads 30 which merge with a bead 31 in the bracket topwall 18.

Each finger 28 tapers from its connection with a sidewall 27 to a rounded end 32, as best seen in FIG. 4, with the taper at its bottom margin 33 being greater than the taper at its top margin 34. Spaced tabs **35*a* and 35*b* are lanced and bend outwardly from each finger 28, and a stiffening bead 36** is formed therebetween.

Figure 1:
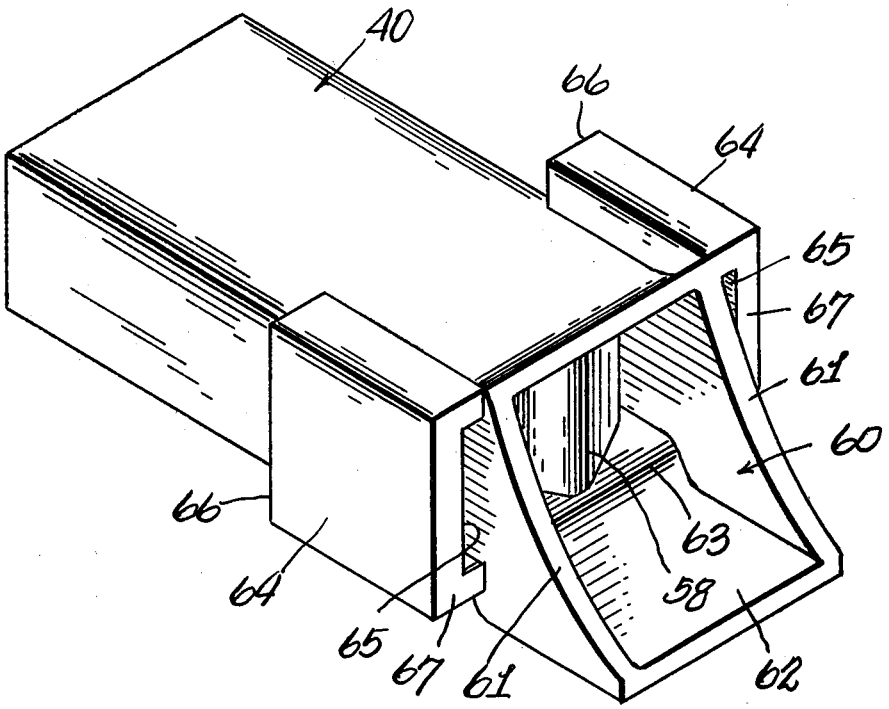
FIG. 1 is an enlarged perspective view of the terminal block.
Figure 2:
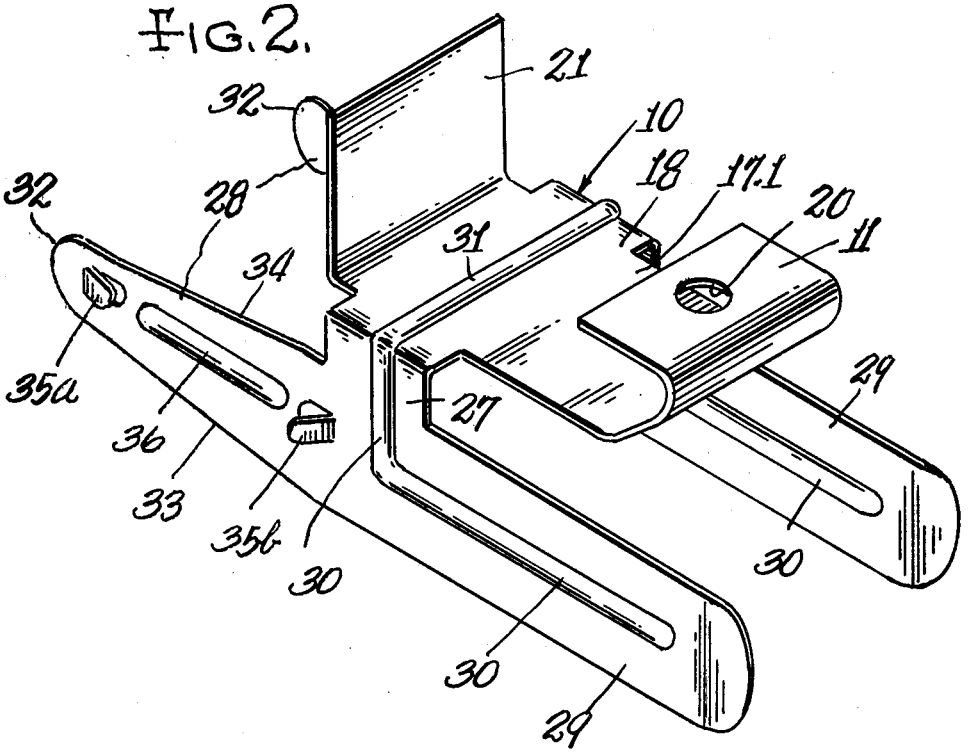
FIG. 2 is an enlarged perspective view of the mounting bracket.
Figure 3:
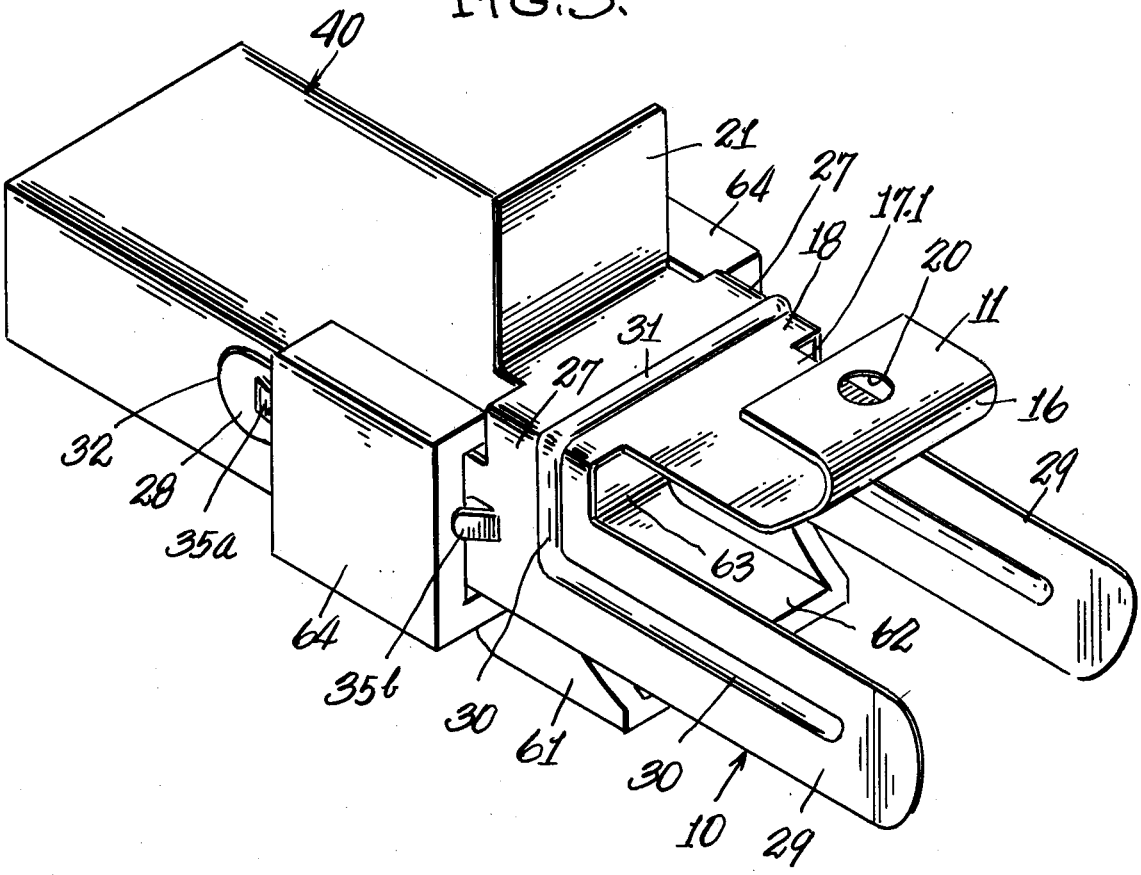
FIG. 3 is a perspective view showing the terminal block and mounting bracket in assembled relation.

The terminal block 40 is formed of any suitable rigid plastic material, and is preferably rectangular in cross-section, as shown in FIG. 1. The block has a hollow central island 41 (see FIG. 5) to provide oppositely-disposed passageways 42–42 in which spring-contact fingers 43 are respectively disposed. Each finger has the wire of an insulated conductor 44 secured to its rear end, and has an angled forward end 45.

Lugs 46 and 47 are integrally formed on the terminal block to extend in opposed spaced relation within each passageway 42. Each contact finger 43 has a tab 48 lanced and bent outwardly therefrom. Each contact finger 43 is easily moved to assembled position by inserting its angled forward end 45 into the rear of a respective passageway 42 and then pushing the contact finger inwardly of the passageway until the tab 48 snaps against the stop formed by the lug 46. This construction is similar to that disclosed in said Ammerman-Cunningham U.S. Pat. No. 3,447,121.

Figure 5:
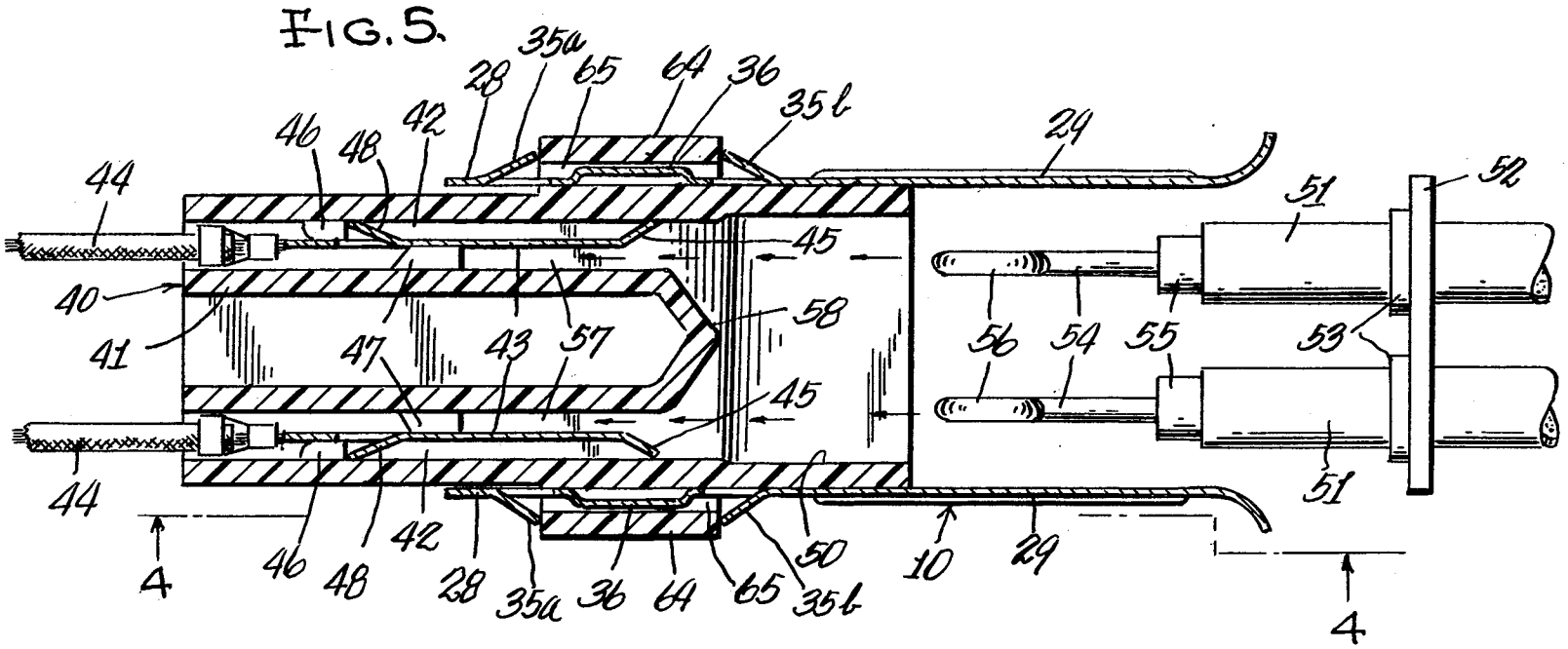
FIG. 5 is a sectional view corresponding generally to the line 5—5 of FIG. 4, and FIGS. 6 and 7 are views similar to FIG. 4, drawn to a reduced scale, showing different angularly related positions of the terminal block and supporting bracket.

The forward end of the terminal block is open, and slightly belled, as seen at 50 in FIG. 5, to receive the terminal portion of a customary surface unit. Such terminal portion includes a pair of terminal legs 51–51 of the metal-sheathed heating unit. The legs are held in laterally-spaced relation by a metal cross-plate 52, which has integral collars 53 crimped to respective legs. Terminal pins 54–54 extend outwardly from bushings 55 in the ends of the terminal legs. The free ends 56 of the terminal pins may be bent to buttonhook shape, as disclosed in said U.S. Pat. No. 3,447,121. Each terminal pin free end 56 is adapted to fit within an elongated space 57 defined by the flat surface of a contact finger 43 and an adjoining flat surface of the island 41, with the buttonhook flatwise therebetween and held in good electrical engagement with a respective contact finger. The construction is such that the cross-plate 52 engages the blades 29 of the bracket before the terminal pins 54 engage the contact springs 43, to ground the surface unit before it receives any electrical current. As seen in FIG. 5, the forward nose portion 58 of the island 41 is angular so as to guide the terminal pin ends 56 toward proper spaces 57 in the event any misalignment in assembly occurs.

The forward open end of the terminal block is scoop-like in formation, as best seen at 60 in FIG. 1, the scoop including sidewalls 61–61 spaced to receive and guide the terminal portion of the surface unit, and the floorwall 62 provides a target surface for the buttonhook ends 56 of the terminal pins 54. The floorwall 62 has an inner upwardly-curved portion 63 to guide the buttonhook ends 56 into the elongated spaces 57 within the terminal block. Thus, the scoop formation 60, in combination with the angular nose 58 of the island 41, insures that the buttonhook ends are guided into correct spaces 57.

As best seen in FIGS. 1 and 5, the forward end of the terminal block 40 has a pair of bosses 64–64 integral with and extending from opposite sides thereof. Each boss has a rectangular socket opening 65 as seen in FIG. 4. To assemble the mounting bracket 10 with the terminal block 40, it is merely necessary to horizontally align the fingers 28 with respective openings 65 and press the mounting bracket in a direction rearwardly of the terminal block. This assembly movement is continued so as to depress the rear tabs 35*a* as they pass through a respective opening until such tabs clear the rearwall 66 of the lugs 64, whereupon they will spring outwardly. The mounting bracket 10 will therefore be held in assembled relation with the terminal block since the tabs 35*a* are engageable with the rearwall 66 of respective lugs 64, and the tabs 35*b* are engageable with the forward wall 67 of such lugs.

Figure 7:
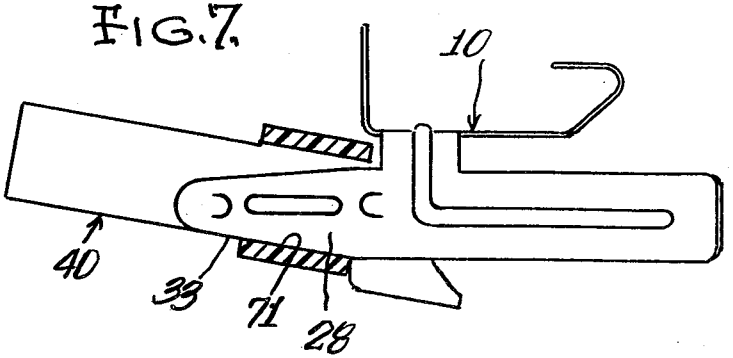
Figure 6:
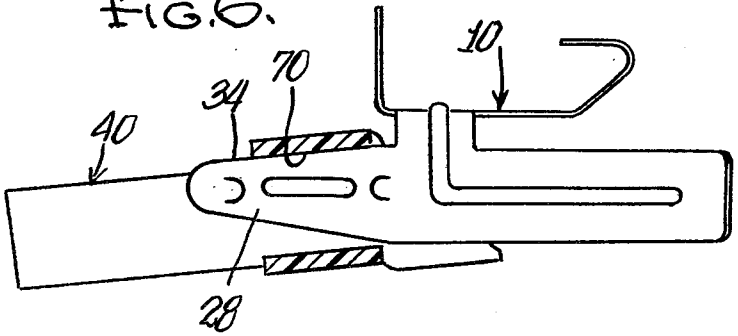

The tabs 35*a* and 35*b*, and the tapered margins 33–34 of the fingers 28, permit the terminal block 40 to swing vertically to two extreme positions shown in FIGS. 6 and 7. In the usual movement of a surface unit to plug-in connection with a terminal block, the unit is moved downwardly along an inclined plane with its terminal portions moving toward the opening in the terminal block. Normally, the terminal block is not clearly visible to the person installing a surface unit, and the swinging mounting of the terminal block is of great value in providing for assembly of the surface unit along the inclined plane and to its normal horizontal operating position.

As shown in FIG. 6, downward tilting of the terminal block 40 is limited by engagement of the upperwall 70 of the lug opening with the top margin 34 of a finger 28. Upward tilting movement of the terminal block 40 is limited by engagement of the lowerwall 71 of the lug opening with the bottom margin 33 of a finger, as shown in FIG. 7.

I claim:

1. In an assembly for a plug-in electrical heating element for a stove, comprising a terminal block of rigid dielectric material having openings configured to receive terminals on the heating element and containing conductor elements resiliently engageable with said terminals, and a sheet-metal mounting bracket connectable to a part of the panel of said stove and adapted to support said terminal block, the improvement comprising:

means providing a socket in said terminal block, finger means on said mounting bracket having plug-in connection with said socket, said finger means being adapted to be seated within said socket and when so seated, having spaced abutments engageable with marginal surfaces defining said socket to maintain the assembly of said terminal block with said mounting bracket, said finger means being in the form of a tapered blade-like member and said socket being in the form of a rectangular, narrow opening to receive said blade-like member in flatwise relation, the taper of said member and the spacing of said abutments providing for vertical swinging movement of said terminal block relative to said mounting bracket.

2. In an assembly for a plug-in electrical heating element for a stove, comprising a terminal block of rigid dielectric material having openings configured to receive terminals on the heating element and containing conductor elements resiliently engageable with said terminals, and a sheet-metal mounting bracket connectable to a part of the panel of said stove and adapted to support said terminal block, the improvement comprising:

a socket at each of opposite sides of said terminal block and extending parallel therewith, said mounting bracket having a top wall and side walls depending from said top wall at opposite sides thereof, said top wall having a portion for attachment to said stove panel, and a finger extending from each bracket side wall and adapted to be plugged into a respective terminal block socket by movement parallel to an adjoining side of said terminal block and when plugged in being seated within the respective socket and operative to connect said terminal block and said bracket.

3. The construction according to claim 2 wherein at least one of said fingers is formed with spaced abutments which are engageable with marginal surfaces defining the respective socket to maintain the assembly of said terminal block with said mounting bracket.

4. The construction according to claim 2 wherein each finger is a plane horizontal continuation of a bracket side wall, each finger having spaced abutments lanced and bent outwardly of the plane thereof, the spaced abutments of each finger being engageable with marginal surfaces defining the respective socket to maintain the assembly of said terminal block and said mounting bracket.

5. The construction according to claim 4 wherein each bracket side wall has a grounding blade extending therefrom in a direction opposite to that of a respective finger.

6. In an assembly for a plug-in electrical heating element for a stove, comprising a terminal block of rigid dielectric material having openings configured to receive terminals on the heating element and containing conductor elements resiliently engageable with said terminals, and a sheet-metal mounting bracket connectable to a part of the panel of said stove and adapted to support said terminal block, the improvement wherein said mounting bracket is formed with a top wall and side walls depending from said top wall at opposite sides thereof, said top wall having a portion for attachment to said stove panel, a generally-flat finger extending from each bracket side wall as a continuation thereof, the fingers extending in the same direction from said side walls, and a socket at each of the opposite sides of said terminal block each to receive a respective finger in close flatwise relation.

* * * * *